US006422898B1

(12) United States Patent
Harvey et al.

(10) Patent No.: US 6,422,898 B1
(45) Date of Patent: Jul. 23, 2002

(54) RETAINING HOOK ASSEMBLY FOR OUTLET COVER

(75) Inventors: John D. Harvey, Trophy Club; Kenneth C. Simonson, Arlington, both of TX (US)

(73) Assignee: Corning Cable Systems LLC, Hickory, NC (US)

( * ) Notice: Subject to any disclaimer, the term of this patent is extended or adjusted under 35 U.S.C. 154(b) by 0 days.

(21) Appl. No.: 09/652,446

(22) Filed: Aug. 31, 2000

(51) Int. Cl.[7] ..... H01R 13/66
(52) U.S. Cl. ..... 439/536; 439/557
(58) Field of Search ..... 439/535, 536, 439/537, 538, 557

(56) References Cited

U.S. PATENT DOCUMENTS 4,875,880 A * 10/1989 Welch et al. ..... 439/536
5,961,345 A * 10/1999 Finn et al. ..... 439/536
6,200,160 B1 * 3/2001 Drexler et al. ..... 439/536

* cited by examiner

*Primary Examiner*—Tho D. Ta
*Assistant Examiner*—Truc Nguyen

(57) ABSTRACT

An outlet cover assembly is described that provides a base portion with a face plate opening for two face plates that are removable from the base portion. One of the face plates has a jack opening for retaining a jack therein. A retaining hook assembly for the jack is provided by a first hook detail that located on the face plate and a second hook detail located on the cover panel. When the face plate is secured within the face plate opening, the first and second hook details become aligned opposite one another and are operable to selectively engage hook portions on the jack. Because each of the hook details are formed on separate components, neither component must be formed using a collapsible insert.

13 Claims, 6 Drawing Sheets

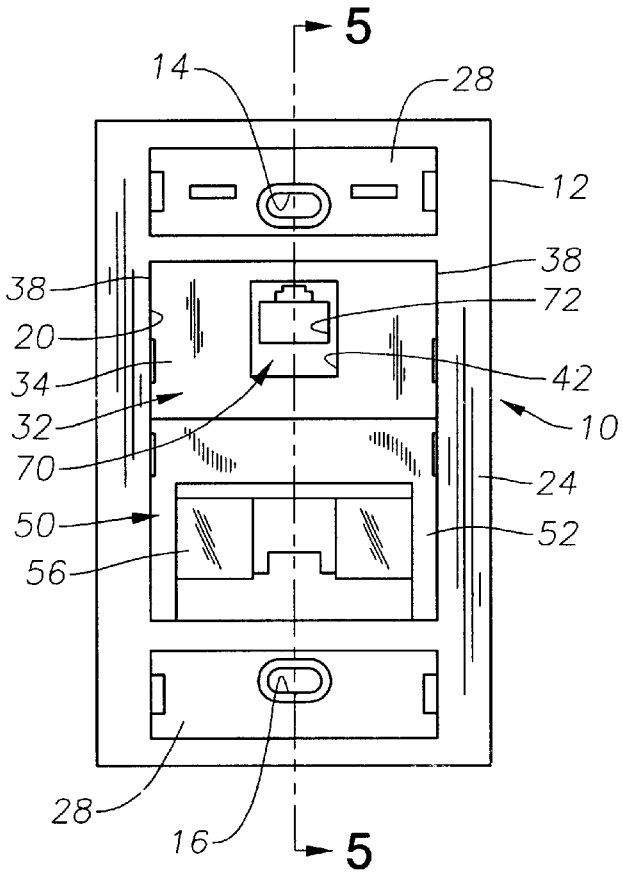
FIGURE 4
FIGURE 5
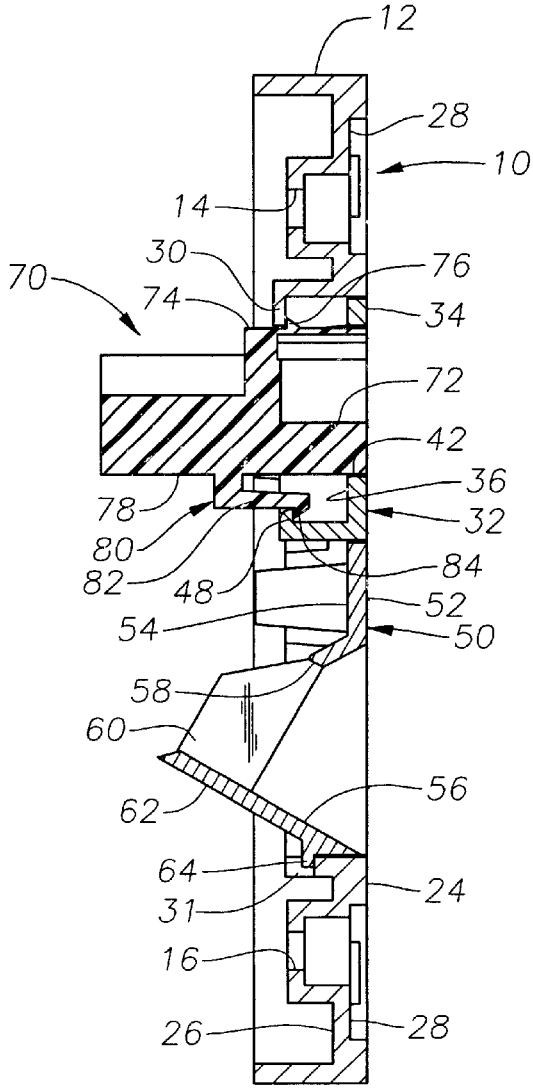

RETAINING HOOK ASSEMBLY FOR OUTLET COVER

BACKGROUND

The present invention is directed to an improved wall mountable outlet cover used for securing jacks. In other aspects, the invention is directed to arrangements for retaining jacks within outlet covers.

Wall mountable outlet covers feature a substantially flat plate that is secured to a wall or other support surface using screw connectors. The plate has an opening within which a jack is secured so that plugs may be removably disposed into a plug receptacle in the jack. To secure the jack within the opening, a retaining hook assembly is integrally formed into the plate on the periphery of the opening. The retaining hook assembly is made up of a pair of opposing hinge details that are placed in opposition to one another on either side of the opening. It is, however, relatively difficult and costly to produce face plates having opposing hook details. The molding process for these requires a collapsible insert for the forming tool. It would be an improvement to have an outlet cover that did not require such an insert, thereby providing greater ease of manufacture and an associated reduction in cost.

SUMMARY OF THE INVENTION

An exemplary outlet cover assembly is described having a base portion that provides a face plate opening for two face plates that are removable from the cover panel. One of the face plates has a jack opening for retaining a jack therein. A retaining hook assembly for the jack is provided by a first hook detail that located on the face plate and a second hook detail located on the cover panel. When the face plate is secured within the face plate opening, the first and second hook details become aligned opposite one another and are operable to selectively engage hook portions on the jack. Because each of the hook details are formed on separate components, neither component must be formed using a collapsible insert.

BRIEF DESCRIPTION OF THE DRAWINGS

FIG. 4 illustrates is a frontal view of the outlet cover assembly shown in FIGS. 1–3.

FIG. 5 is a cross-sectional view taken along lines 5—5 in FIG. 4.

DETAILED DESCRIPTION OF THE INVENTION

Figure 1:
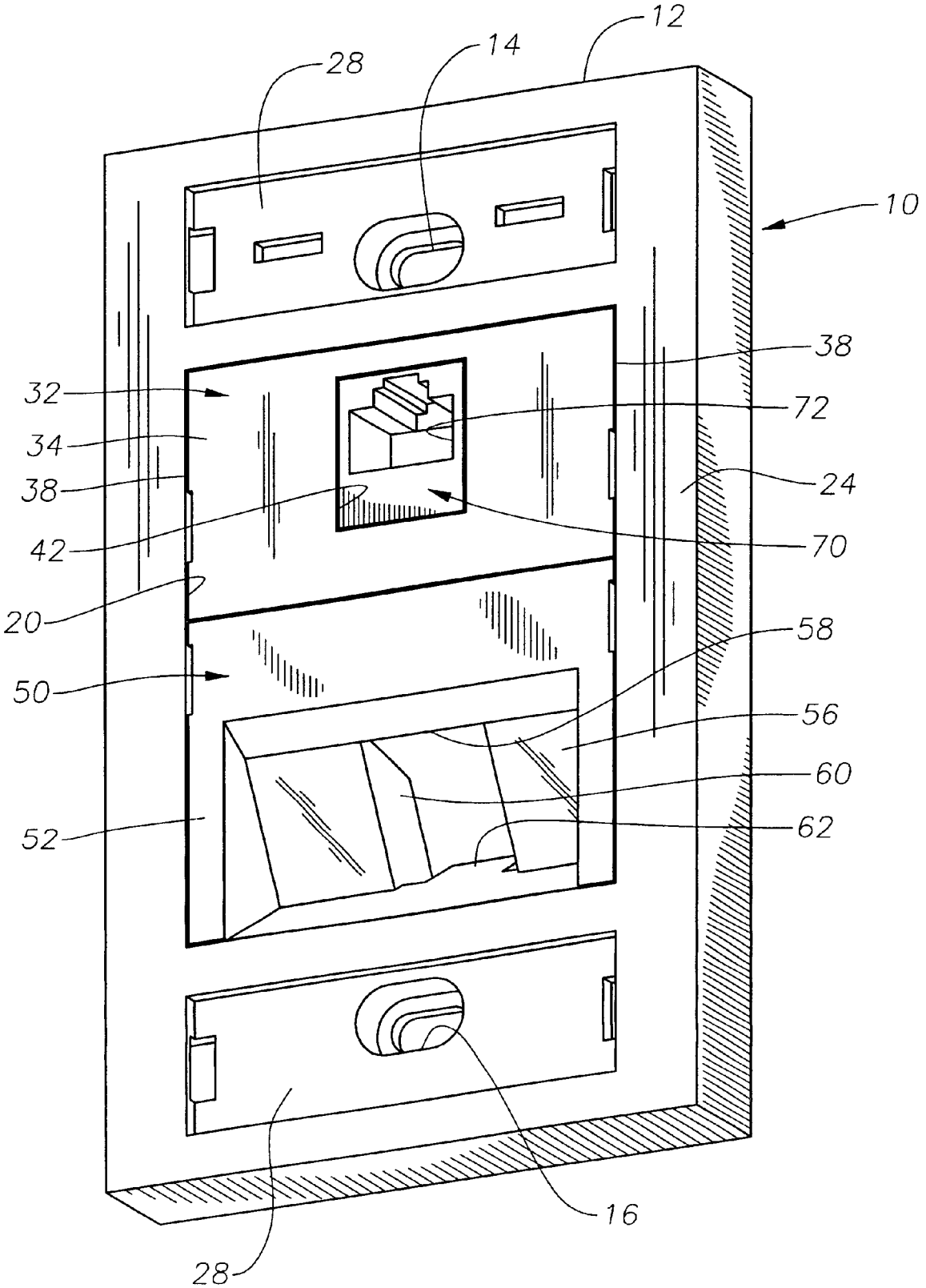
FIG. 1 is an front perspective view of an exemplary outlet cover assembly in accordance with the present invention.
Figure 2:
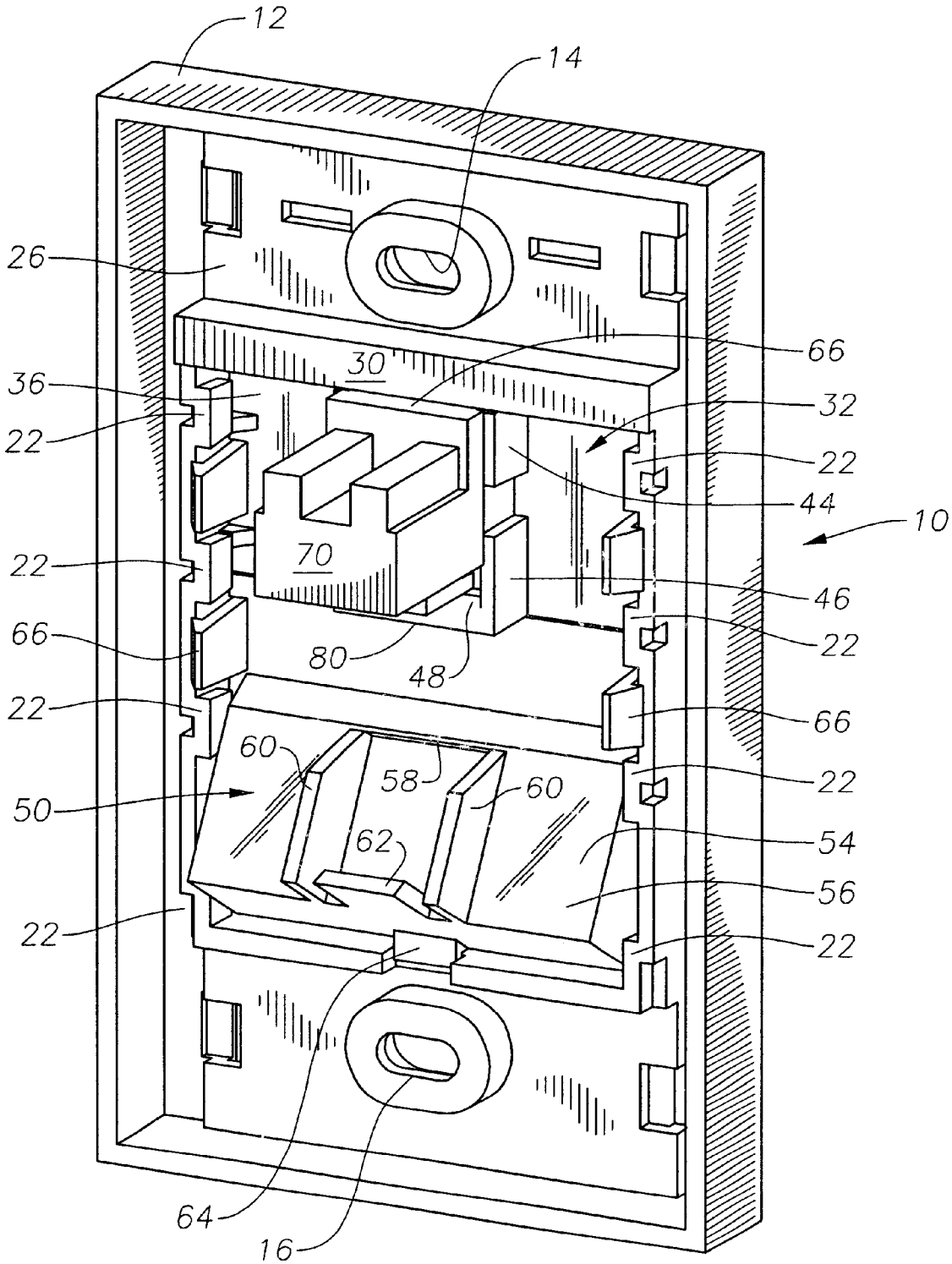
FIG. 2 depicts a rear perspective of the outlet cover assembly shown in FIG. 1
Figure 3:
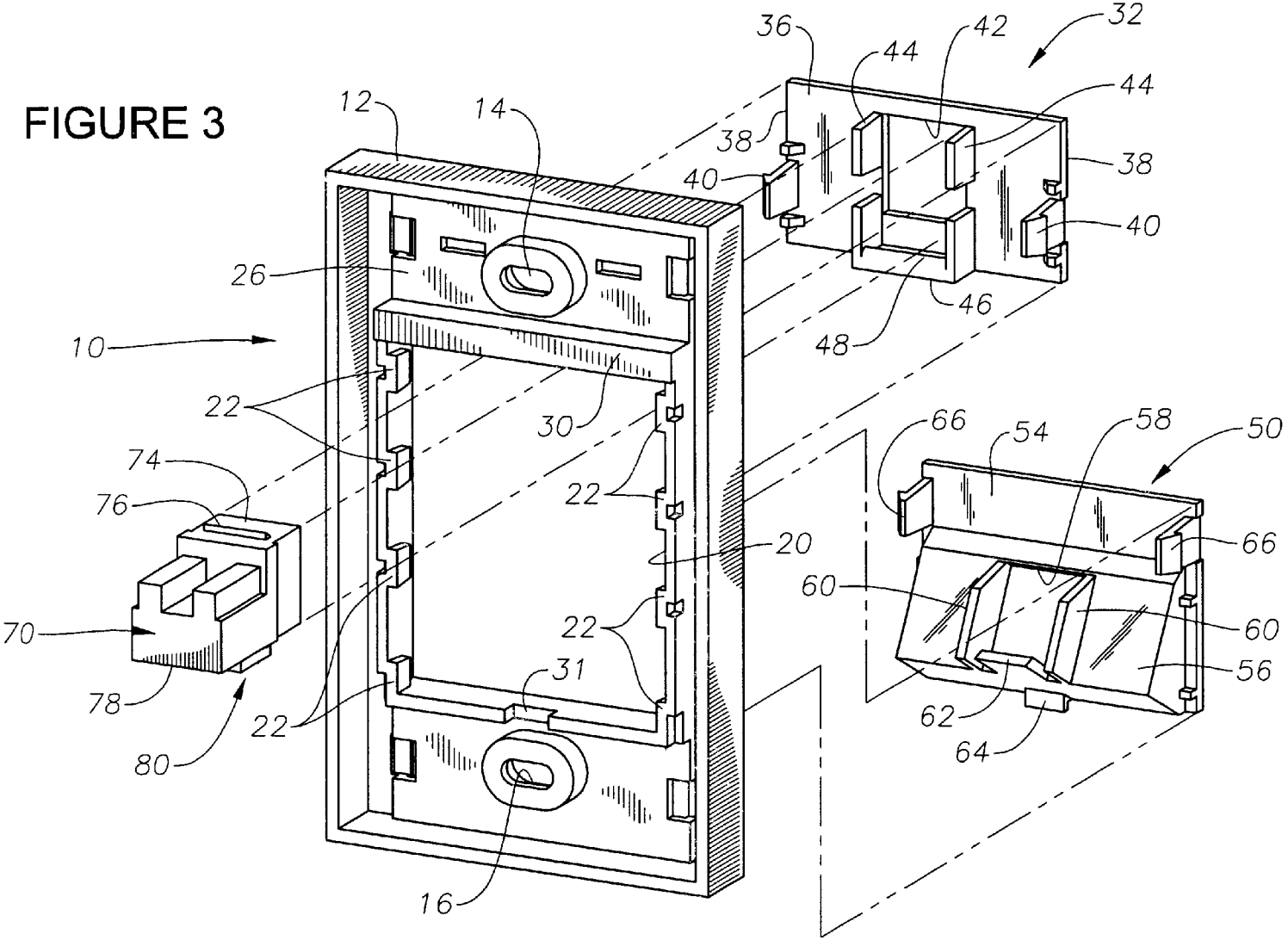
FIG. 3 is an exploded rear view of the outlet cover assembly shown in FIGS. 1 and 2.

FIGS. 1 through 7 depict an exemplary outlet cover assembly 10 having a base section 12 and two removable face plates 32 and 50, which will be described in detail shortly. The outlet cover assembly 10 is shaped and sized to be affixed to a wall or other support surface (not shown) by securing screws or other fasteners (not shown). The base section 12 is preferably rectangular in shape (although any size and shape could be used) and contains upper and lower apertures 14, 16 through which fasteners are disposed. The base section 12 also contains a central face plate opening 20, best shown in FIG. 3, that is also preferably rectangular in shape as well. Opening 20 could be any size or shape, depending on the size and shape of the face plates 32, whose size and shapes may, in turn, depend of the size and shape of the connectors or plugs/jacks that are used. As best seen in FIGS. 2 and 3, four projections 22 are located on either lateral side of the face plate opening 20, which assist in stabilizing and maintaining the face plates 32,50 flush with the base section 12. The front side surface 24 of the base section 12 is the side that is normally visible when the outlet cover 10 is affixed to a wall or other support surface. The reverse side 26 is placed adjacent the wall or support surface and becomes hidden from view when in use. It is noted that the front side surface 24 may also have rectangular recessed portions 28 proximate the upper and lower ends into which labels (not shown) may be secured. The reverse side 26 of the base section 12 has a downwardly projecting flange 30 that extends across the upper end of the face plate opening 20. The flange 30 is visible in FIGS. 2, 3 and 5. As will be described in greater detail later, the flange 30 provides a hinge detail that is useful for retaining jacks. The lower end of the face plate opening 20 has a notch 31 cut into the reverse side 26.

A removably insertable upper face plate 32 is shown that is generally rectangular in shape. The upper face plate 32 also presents a front side surface 34 and a reverse side surface 36. Each of the lateral sides 38 of the upper face plate 32 have a tang 40 that projects rearwardly away from the reverse side surface 36. A rectangular jack opening 42 is centrally disposed through the upper face plate 32. The reverse side surface 36 of the upper face plate 32 presents a pair of jack alignment tabs 44 that are situated on either lateral side of the jack opening 42. These tabs 44 engage each side of jack to help align the jack with the opening 42. The tabs 44 also engage the flanges on the copper jack 70 to ensure that the jack is flush with the front side surface 34 of the face plate 32 and is not pushed too far.

Figure 6:
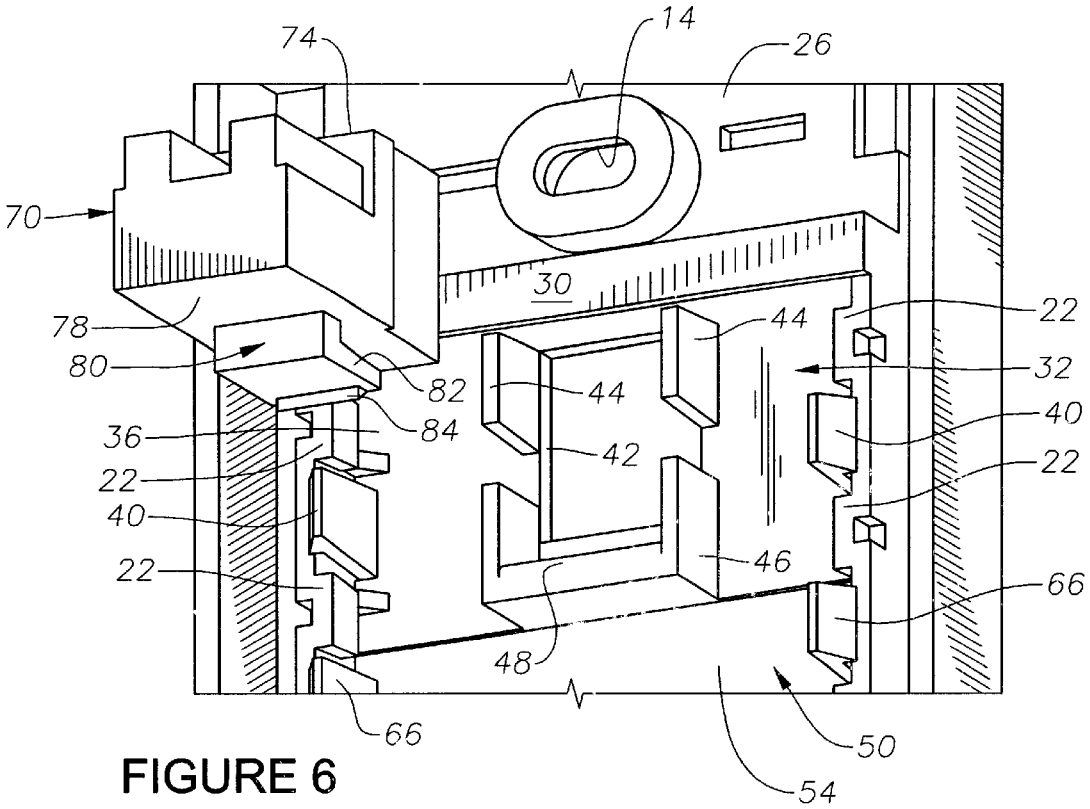
FIGS. 6 and 7 are enlarged views depicting insertion of a copper jack into the outlet cover assembly.
Figure 7:
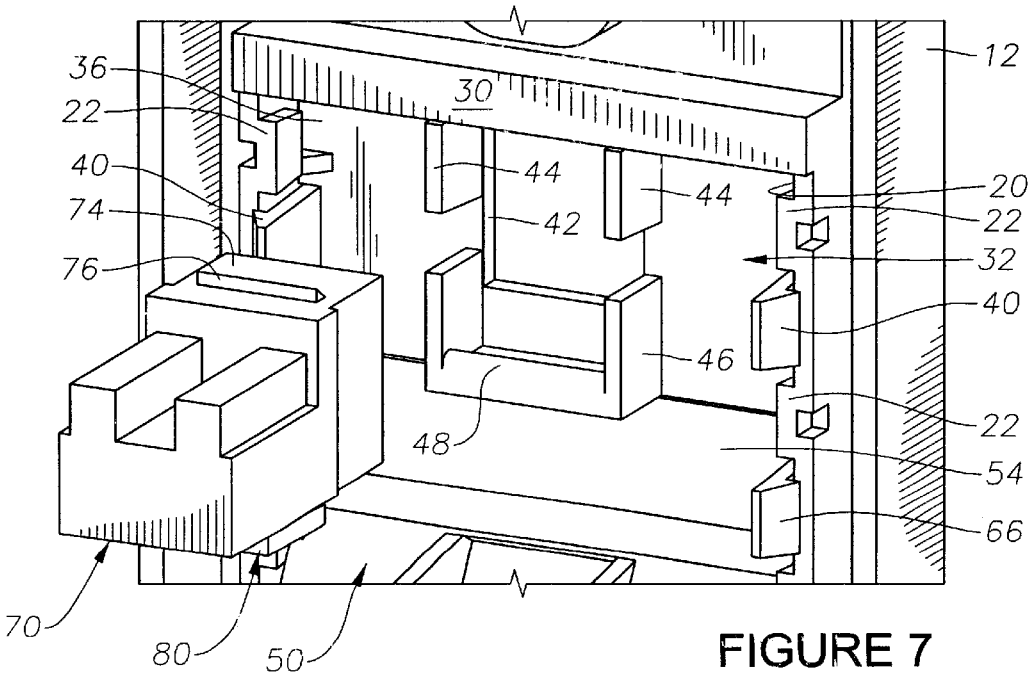

A U-shaped bracket 46 is located below the tabs 44 and projects rearwardly from the reverse side surface 36 of the upper face plate 32. As best shown in FIGS. 3, 6, and 7, the bracket 46 has a pair of flat vertically oriented side pieces (which also assist in preventing the jack 70 from going too far forward) and an interconnecting cross-piece. The cross-piece has an upwardly-projecting flange 48.

A lower face plate 50 is shown as generally rectangular and presents a front side surface 52 and reverse side surface 54. The lower face plate 50 has an angularly recessed central portion 56 that contains jack opening 58. The jack opening 58 is sized and shaped to receive and retain a fiber optic jack (not shown). The angular recession of the central portion 56 causes a fiber optic jack to be retained within the jack opening 58 at an angle to the front side surface 52. Rearwardly projecting jack alignment portions 60 are located on either side of the jack opening 58. A lower jack alignment portion 62 also projects rearwardly along the lower edge of the jack opening 58. The lower end of the lower face plate 50 has a retaining tab 64 that projects downwardly. The retaining tab 64 is shaped and sized to be received within the notch 31 at the lower edge of the face plate opening 20. In addition, tangs 66 are located on either lateral side of the lower face plate 50.

Figure 9:
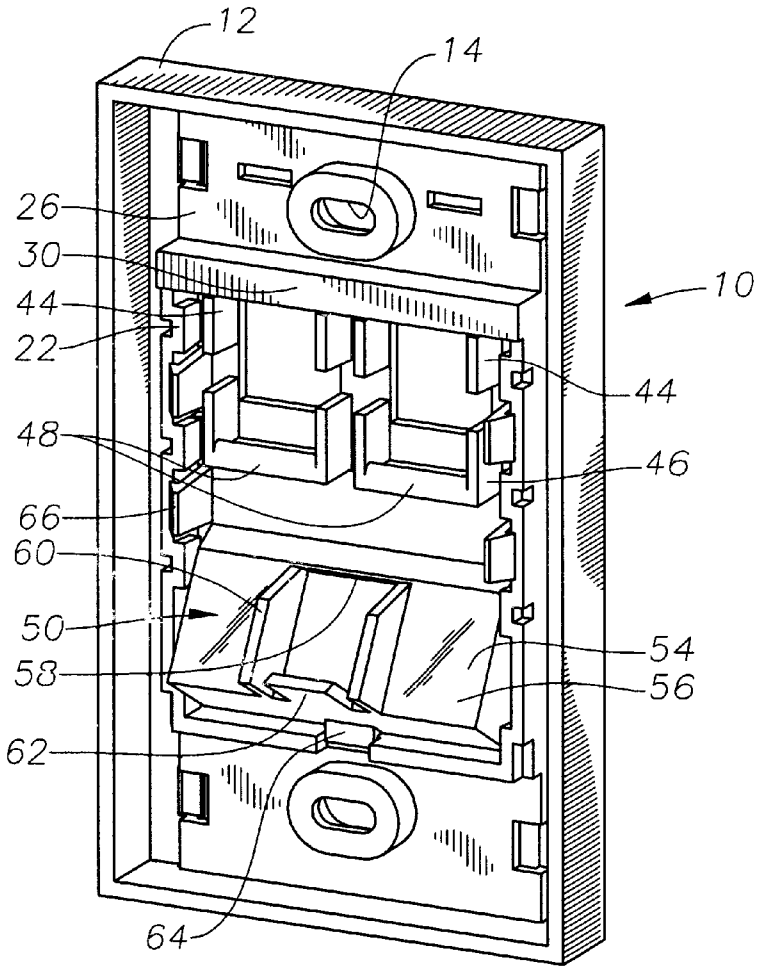
FIGS. 8 and 9 illustrate another embodiment of the outlet cover assembly in accordance with the present invention.
Figure 8:
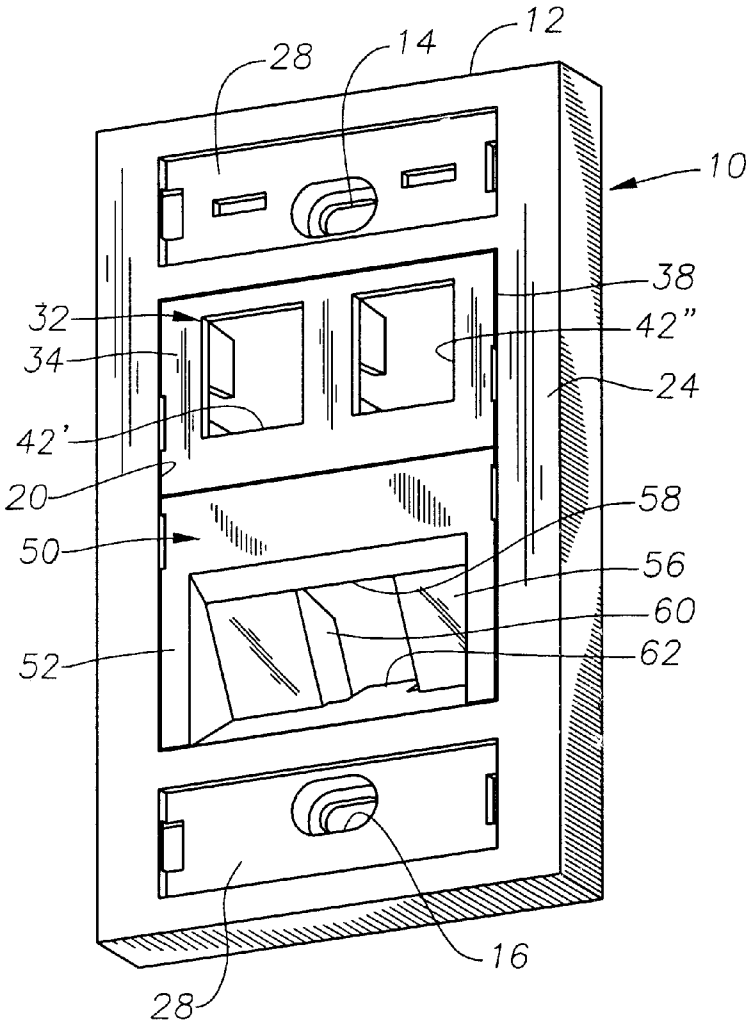

An alternative embodiment is shown in FIGS. 8 and 9. In the alternative embodiments, the upper face plate 32' is the same as in the first embodiment except that face plate 32' has two jack openings 42',42", each one to hold a jack 70 (see FIG. 3). As seen in FIG. 9, each opening 42',42" would have the jack alignment tabs 44, the U-shaped bracket 46, and the upwardly-projecting flange 48 as in the first embodiment. Although not shown, the lower face plate 50 may also have more than one jack opening. It should also be noted that the flange 30 could be divided into two separate flanges when there are two jack openings, although it would be more difficult and expensive to mold.

When the outlet cover 10 is assembled, both the lower face plate 50 and the upper face plate 32 are received and retained within the face plate opening 20 so that the upper and lower face plates 32, 50 adjoin one another. The opening 20 may also be divided into two separate openings rather than as one large opening as shown. The upper face plate 32 is configured to receive and retain a plug for copper wiring while the lower face plate 50 is configured to receive and retain a connector for an optical fiber. During assembly, the lower face plate 50 must be inserted into the face plate opening 20 before the upper face plate 32 is installed. The lower face plate 50 is inserted into the opening 20 from the front side surface 24 of the base portion 12. Insertion is accomplished by disposing the lower edge of the face plate 50 within the lower end of the face plate opening 20 so that the retaining tab 64 becomes disposed within the notch 31 in the face plate opening 20. The upper end of the lower face plate 50 is then urged rearwardly until the tangs 66 lockingly engage the opening 20 between protrusions 22. The fully inserted position is shown in FIGS. 1 and 2.

The upper face plate 32 is then secured within the upper portion of the face plate opening 20 by urging it rearwardly into the opening 20 (as FIG. 3 illustrates) until the tangs 40 lockingly engage the opening 20 between the protrusions 22.

An exemplary copper jack 70 is shown that is received within the jack opening 42 of the upper face plate 32. It is noted that the jack 70 is shown apart from the copper wiring or conductors that would normally be interconnected to the jack 70. The jack 70 is generally block-like and defines a plug receptacle 72 therein to receive a complimentary copper jack plug once the outlet cover 10 is assembled and affixed to a wall. As best shown in FIGS. 5, 6, and 7, the top side 74 of the jack 70 has a pointed ridge 76 that projects upwardly above the top side 74. The forward side of the ridge 76 is slanted while the rear side is substantially vertical.

The lower side 78 of the jack 70 has a spring clip 80 (best seen in FIGS. 5 and 6) that consists of an arm 82 that is affixed to the lower side 78 so that it may be depressed upwardly toward the lower side 78. A downwardly facing ridge 84 is located on the end of the arm 82.

In use, this construction permits the copper jack 70 to be secured within of the outlet cover assembly 10 to present plug receptacle 72 upon the front side surface 24 of the base section 12. The jack 70 is secured within the jack opening 42 by a retaining hook assembly that provides opposing hinge details that engage opposite flanges 76 and 82 on the jack 70. The term "hinge detail", as used herein, is meant to refer to a structure that engages a mating portion of a jack in order to help secure the jack in place. The flange 30 of the base portion 12, which provides the first hinge detail, engages the ridge 76 of the jack 70. The second hinge detail is provided by the upwardly-projecting flange 48 of the upper face plate 32 and opposes the first hinge detail when the upper face plate 32 is secured within the face plate opening 20. Because one of the opposing hinge details is provided by the base portion 12, the upper face plate 32 can be more easily and inexpensively created since the molding process for the upper face plate 32 will not require the use of a forming tool with a collapsible insert, as would be required if both opposing hinge details used to retain the jack 70 were located on the upper face plate 32 or on the base portion 12.

It is noted that the construction of the outlet cover assembly 10 is exemplary only. Those skilled in the art will recognize that the retaining hook arrangement described as used within the outlet cover assembly 10 may also be incorporated into other designs for switch plates and the like while providing the same benefits of reduced cost and ease of manufacture.

What is claimed is:

1. An outlet cover assembly comprising:

a base portion to be affixed to a support surface, the base portion defining at least one face plate opening and providing at least one first hinge detail for engaging a first ridge on a first jack; and a first face plate that is removably insertable within the at least one face plate opening, the first face plate defining a first jack opening and providing at least one second hinge detail for engaging a second ridge on the first jack, the second hinge detail positioned opposite the first hinge detail and spaced from the first hinge detail so that the first jack is retained within the first jack opening between the first hinge detail and the second hinge detail.

2. The outlet cover assembly of claim 1 wherein the at least one first hinge detail comprises at least one flange located adjacent the at least one face plate opening.

3. The outlet cover assembly of claim 1 wherein the at least one first and second hinge details are shaped and sized to engage the first and second ridges on the first jack.

4. The outlet cover assembly of claim 3 wherein the first jack is a copper jack.

5. The outlet cover assembly of claim 1 wherein the first face plate further comprises a pair of tangs that selectively engage the base portion.

6. The outlet cover assembly of claim 1 further comprising a second face plate that is removably insertable in the at least one face plate opening to adjoin the first face plate.

7. The outlet cover assembly of claim 6 wherein the second face plate defines a second jack opening to retain a second jack.

8. The outlet cover assembly of claim 7 wherein the second jack opening of the second face plate is shaped and sized to retain a fiber optic jack.

9. The outlet cover assembly of claim 8 wherein the second face plate has a central portion that is angularly recessed to cause the fiber optic jack to be retained within the second jack opening of the second face plate at an angle.

10. An outlet cover assembly for retaining a jack proximate a support surface, comprising:

a base portion to be affixed to the support surface, the base portion defining at least one face plate opening for retaining at least one face plate and having a first hinge detail located proximate an edge of the at least one face plate opening for engaging the jack; and a face plate that is selectively securable within the at least one face plate opening, the face plate defining at least one jack opening for receiving the jack and a second hinge detail for engaging the jack that is opposite the first hinge detail when the face plate is secured within the at least one face plate opening, the second hinge detail spaced from the first hinge detail so that the first jack is retained within the at least one jack opening between the first hinge detail and the second hinge detail.

11. The outlet cover assembly of claim 10 wherein the second hinge detail comprises a flange positioned on a rearwardly-projecting portion of the face plate.

12. A retaining hook assembly for an outlet cover, comprising:

a base portion defining a face plate opening and providing a first hinge detail adjacent the face plate opening;

a face plate positioned within the face plate opening, the face plate defining a jack opening and providing a second hinge detail adjacent the jack opening that is opposite and spaced from the first hinge detail; and a jack positioned between the first hinge detail and the second hinge detail so that the jack is retained within the jack opening.

13. The retaining hook assembly of claim 12 wherein the first binge detail comprises a first flange located proximate an edge of the face plate opening and the second hinge detail comprises a second flange located proximate an edge of the jack opening and wherein the jack comprises a first ridge for engaging one of the first flange and the second flange and a second ridge on a spring and for engaging the other of the first flange and the second flange.

* * * * *